US011134713B2

(12) United States Patent
Williams

(10) Patent No.: US 11,134,713 B2
(45) Date of Patent: Oct. 5, 2021

(54) METHOD AND APPARATUS FOR PRODUCING MICRO BEAD BEARING FILTER ROD

(71) Applicant: Altria Client Services LLC, Richmond, VA (US)

(72) Inventor: Dwight David Williams, Powhatan, VA (US)

(73) Assignee: Altria Client Services LLC, Richmond, VA (US)

( * ) Notice: Subject to any disclaimer, the term of this patent is extended or adjusted under 35 U.S.C. 154(b) by 158 days.

(21) Appl. No.: 16/054,418

(22) Filed: Aug. 3, 2018

(65) Prior Publication Data

US 2019/0037912 A1 Feb. 7, 2019

Related U.S. Application Data

(60) Provisional application No. 62/541,259, filed on Aug. 4, 2017.

(51) Int. Cl.
*A24D 3/02* (2006.01)
*A24D 3/06* (2006.01)

(52) U.S. Cl.
CPC ..... *A24D 3/0216* (2013.01); *A24D 3/0229* (2013.01); *A24D 3/0254* (2013.01); *A24D 3/063* (2013.01)

(58) Field of Classification Search
CPC .... A24D 3/0229; A24D 3/0254; A24D 3/063; A24D 3/0216; A24D 3/0225
See application file for complete search history.

(56) References Cited

U.S. PATENT DOCUMENTS

| | | | | |
|---|---|---|---|---|
| 2,682,270 A | | 6/1954 | Schur | |
| 3,623,404 A | * | 11/1971 | Jackson | A24D 3/0225 493/47 |
| 4,285,678 A | * | 8/1981 | Molins | A24D 3/0225 131/67 |
| 5,176,606 A | | 1/1993 | Budjinski, III et al. | |
| 5,542,901 A | * | 8/1996 | Atwell | A24D 3/0225 131/61.1 |
| 6,723,033 B1 | * | 4/2004 | Scott | A24D 3/0212 493/48 |

(Continued)

OTHER PUBLICATIONS

International Search Report and Written Opinion for International Application No. PCT/US2018/045171 dated Oct. 15, 2018.

(Continued)

*Primary Examiner* — Andrew M Tecco
*Assistant Examiner* — Nicholas E Igbokwe
(74) *Attorney, Agent, or Firm* — Hamess, Dickey & Pierce, P.L.C.

(57) ABSTRACT

A system and method for manufacturing a filter includes a filamentary material delivery apparatus, a support structure for supporting a continuous stream of filamentary material, and a particle distribution apparatus. The particle distribution apparatus includes an apertured distribution belt positioned above the support structure and in communication with an outlet of a particle storing hopper. The belt defines a plurality of spaced openings through which particles are distributed onto the continuous stream of filamentary material to form a particle-bearing stream of filamentary material.

23 Claims, 3 Drawing Sheets

(56) References Cited

U.S. PATENT DOCUMENTS

| | | | | |
|---|---|---|---|---|
| 2010/0184576 | A1* | 7/2010 | Prestia | A24D 3/061 493/39 |
| 2011/0053745 | A1 | 3/2011 | Iliev et al. | |
| 2014/0261475 | A1* | 9/2014 | Kizer | A24D 3/14 131/275 |
| 2014/0263408 | A1* | 9/2014 | Amiss | B65B 1/363 222/1 |
| 2014/0364291 | A1* | 12/2014 | Ferrazzin | A24D 3/0254 493/4 |
| 2016/0143350 | A1* | 5/2016 | Figarski | A24D 3/0254 493/50 |

OTHER PUBLICATIONS

Extended European Search Report dated Mar. 24, 2021 for corresponding European Application No. 18841060.9.

* cited by examiner

METHOD AND APPARATUS FOR PRODUCING MICRO BEAD BEARING FILTER ROD

CROSS-REFERENCE TO RELATED APPLICATIONS

This application claims the benefit of U.S. Provisional Application No. 62/541,259, filed on Aug. 4, 2017, the disclosure of which is incorporated herein by reference thereto in its entirety.

BACKGROUND

Field

Example embodiments relate to systems and methods for delivering discrete amounts of particulate material during high speed manufacturing of particulate bearing articles of manufacture. At least one example embodiment relates to systems and methods for repetitively delivering discrete amounts of particulate additives to cigarette filter tow material.

Description of Related Art

The statements in this section merely provide background information related to the present disclosure and may not constitute prior art.

Articles of manufacture such as particle bearing cigarette filters, individual-sized packets of granular food products or condiments, capsuled pharmaceuticals, ammunition and the like may require repetitive placement of precisely metered charges of particulate matter at some location along the production-line procession of the articles. Difficulties may arise in pursuing sufficient speed in the mass production of such articles without sacrificing consistency, damaging the material and/or exacerbating spillage, particularly at elevated manufacturing speeds where ricochet and vibration may impair process control and consistency.

With machines of the prior art, process control may suffer at high machine speeds from inconsistent metering and pulverization of the material, particularly in those prior machines where fast moving machine components are allowed to impinge stationary or relatively slow moving particulate material. For example, certain prior particle metering devices contain a supply of particle in a hopper and allow the rim of a rotating metering wheel to rotate through the relatively stationary collection of particles. Such an arrangement creates a pulverizing action upon the particles which generally increases with machine speed.

Existing devices that pulverize or otherwise damage particles cannot be utilized when handling frangible particles, such as liquid-filled flavor beads. Further, ricochet and escape of particulate matter during manufacturing operations with prior art machines may create unacceptable deficiencies in the final product (such as smears or incomplete fillings) and precipitate undesirable machine "downtimes" to effect clean-up of the machine and the surrounding work environment.

Filter rods have been produced having particles distributed uniformly throughout the filter rod. With such filter rods, particles are cut as the rod is converted into segments, thereby dulling the knife and producing particle dust and scatter. Further, rods which continuously distribute particles require a secondary combining operation to produce a final filter with a mouthpiece segment void of particles.

A plug-space-plug method of producing filters, wherein particles are inserted into spaces between plugs, has been employed. However, this method may require the expense of a combined filter, where the carbon-on-tow filter is combined with a mono mouthpiece.

SUMMARY

At least one example embodiment relates to a system for manufacturing a filter.

In at least one example embodiment, a system for manufacturing a filter may include a filamentary material delivery apparatus, a support structure, and a particle distribution apparatus. The support structure supports a continuous stream of filamentary material supplied by the filamentary material delivery apparatus. The particle distribution apparatus is disposed downstream of the filamentary material delivery apparatus and further includes a hopper and an aperture distribution belt. The hopper stores particle material having an outlet. The apertured distribution belt is positioned above the support structure and in communication with the outlet of the hopper. The aperture distribution belt defines a plurality of spaced openings through which particle material is distributed onto the continuous stream of filamentary material to form a particle-bearing stream of filamentary material.

In at least one example embodiment, the particle-bearing stream of filamentary material may further comprise discrete spaced-apart groupings of the particle material.

In at least one example embodiment, the system may further include a closing unit disposed downstream of the particle distribution apparatus for closing the particle-bearing stream of filamentary material so as to capture groupings of particle material at discrete locations within a closed rod of filamentary material.

In at least one example embodiment, the system may further include a cutter disposed downstream of the closing unit for cutting the closed rod into discrete filter plugs or 2-up pairs of filter plugs.

In at least one example embodiment, the system may further include a fluid applicator structured and arranged to apply fluid to the continuous stream of filamentary material upstream of the particle distribution apparatus, such that that particle material is distributed onto a wet continuous stream of filamentary material.

In at least one example embodiment, the fluid may be a plasticizer, and the particle material distributed onto the wet continuous stream of filamentary material may be at least partially adhered to the continuous stream of filamentary material by the plasticizer.

In at least one example embodiment, the support structure may be a solid, planar support structure.

In at least one example embodiment, the continuous stream of filamentary material below the particle distribution apparatus may have a planar, ribbon-like shape.

In at least one example embodiment, The particle material may comprise rupturable beads.

In at least one example embodiment, the particle material may comprise carbon granules.

In at least one example embodiment, the apertured distribution belt may be advanced at the same speed as the continuous stream of filamentary material.

In at least one example embodiment, a bottom of the apertured distribution belt may be mounted at a distance from the support structure such that a particle accumulation space is provided between the particle distribution apparatus and the continuous stream of filamentary material.

At least one example embodiment relates to a method for manufacturing a filter.

In at least one example embodiment, a method for manufacturing a filter may include advancing a continuous stream of filamentary material along a support structure located beneath a particle distribution apparatus; and distributing particle material through spaced openings in an aperture distribution belt of the particle distribution apparatus onto the continuous stream of filamentary material, thereby forming a particle-bearing stream of filamentary material.

In at least one example embodiment, the particle-bearing stream of filamentary material may contain discrete spaced-apart groupings of the particle material.

In at least one example embodiment, the method may further include closing the particle-bearing stream of filamentary material so as to capture groupings of particle material at discrete locations within a closed rod of filamentary material.

In at least one example embodiment, the method may further include cutting the closed rod into discrete filter plugs or 2-up pairs of filter plugs.

In at least one example embodiment, the method may further include applying fluid to the continuous stream of filamentary material upstream of the particle distribution apparatus, such that that particle material is distributed onto a wet continuous stream of filamentary material.

In at least one example embodiment, the method may further include applying a plasticizer as the fluid, such that the particle material distributed onto the wet continuous stream of filamentary material is at least partially adhered to the continuous stream of filamentary material by the plasticizer.

In at least one example embodiment, the method may further include advancing the continuous stream of filamentary material along a solid, planar support structure as the support structure.

In at least one example embodiment, the method may further include distributing the particle material onto the continuous stream of filamentary material having a planar, ribbon-like shape.

In at least one example embodiment, the method may further include distributing the particle material having rupturable beads.

In at least one example embodiment, the method may further include distributing the particle material having carbon granules.

In at least one example embodiment, the method may further include advancing the aperture distribution belt at a same speed as the continuous stream of filamentary material.

In at least one example embodiment, the method may further include distributing particle material through the spaced openings in the apertured distribution belt which is mounted at a distance from the support structure such that the particle material crosses a particle accumulation space provided between the particle distribution apparatus and the continuous stream of filamentary material after passing through the spaced openings.

DRAWINGS

The drawings described herein are for illustration purposes only and are not intended to limit the scope of the present disclosure in any way.

Example embodiment will now be described, by way of example only, with reference to the accompanying drawings.

DETAILED DESCRIPTION

Figure 1:
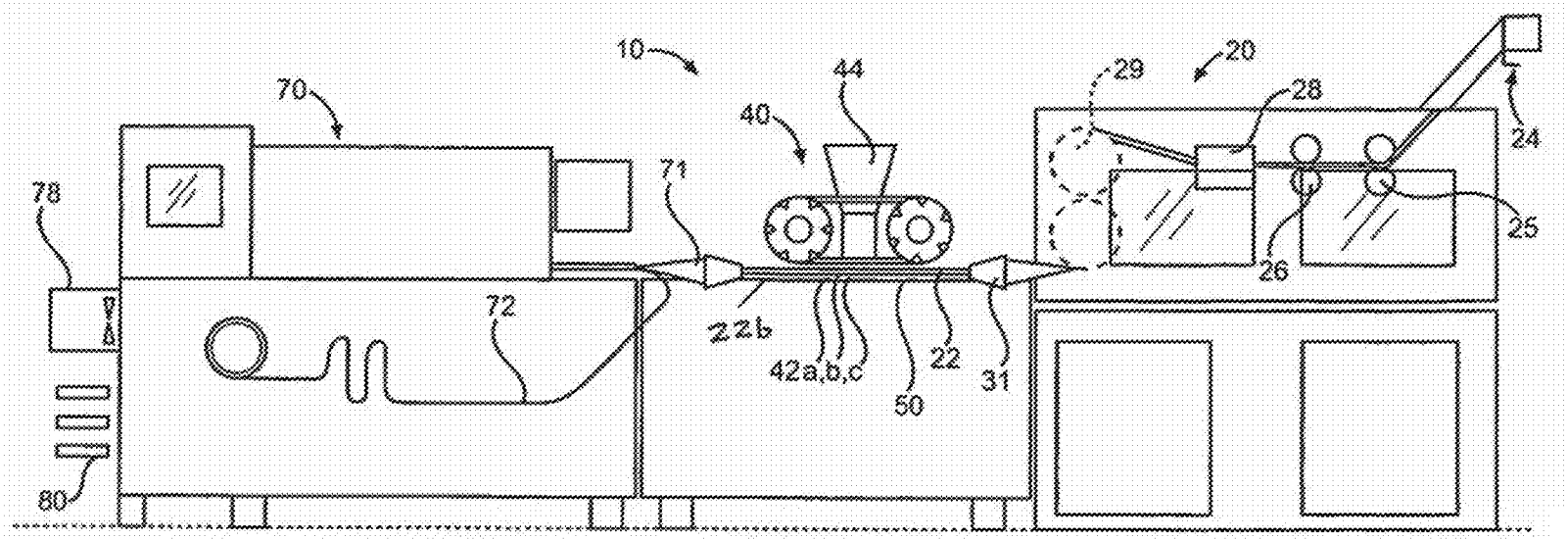
FIG. 1 is a schematic side view of a filter rod maker system constructed in accordance with at least one example embodiment.

Example embodiments will become more readily understood by reference to the following detailed description of the accompanying drawings. Example embodiments may, however, be embodied in many different forms and should not be construed as being limited to the example embodiments set forth herein. Rather, these example embodiments are provided so that this disclosure will be thorough and complete. Like reference numerals refer to like elements throughout the specification.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings set forth herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Example embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these example embodiments should not be construed as limited to the particular shapes of regions illustrated herein, but are to include deviations in shapes that result, for example, from manufacturing. Thus, the regions illustrated in the figures are schematic in nature and their shapes are not intended to illustrate the actual shape of a region of a device and are not intended to limit the scope of this disclosure.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

In at least one example embodiment, as shown in FIG. 1, a system 10 for producing a filter rod is configured to construct particle-bearing filter rods. In at least one example embodiment, the system 10 comprises a filamentary material treatment and delivery apparatus 20 (hereafter tow delivery apparatus 20), a particle distribution apparatus 40, and a filter rod maker 70, each of which will be discussed in more detail below.

In at least one example embodiment, the tow delivery apparatus 20 generates a continuous stream of filamentary material 22, such as cellulose acetate tow, for example. The tow delivery apparatus 20 may be based on a known tow treatment apparatus such as an AFI-E apparatus from Hauni-Körber AG of Hamburg, Germany. Such machines typically include a feed arm 24 configured to direct a continuous strand of tow material before a set of pretension rollers 25, a set of threaded, blooming rollers 26, a fluid or plasticizer applicator 28, a plurality of delivery rollers 29, and finally a transport stuffer jet 31, all of which cooperate to form the continuous stream of filamentary material 22 at the exit of the tow delivery apparatus 20 in certain example embodiments. In at least one example embodiment, the transport stuffer jet 31 may be modified to establish a planar, ribbon-like shape to the continuous stream of filamentary material 22 at the exit of the transport jet 31.

In at least one example embodiment, the plasticizer applied by the plasticizer applicator 28 may be a softening agent that is added in small quantities to the cellular acetate tow to tack the fibers together at points where the filaments cross one another. Examples of plasticizers include, but are not limited to, triacetin (also known as glycerol triacetate, or PZ), trimethylene glycol diacetate (also known as TEGDA), and mixtures thereof. In some example embodiments, a plasticizer applicator 28 is located upstream of particle distribution apparatus 40, such that the filamentary material 22 is tacky with plasticizer applied by the plasticizer applicator 28 as it moves beneath the particle distribution apparatus 40.

In at least one example embodiment, particle distribution apparatus 40 is operatively located between the tow delivery apparatus 20 and the filter rod maker 70, and is arranged to consistently deliver desired (or alternatively, predetermined) amounts of particle material at discrete, spaced apart locations 42 (for example locations 42*a*, 42*b*, 42*c*, in FIG. 1) defined along the continuous stream of filamentary material 22. In at least one example embodiment, the particle distribution apparatus 40 enables the distribution of spaced, discrete mounds (e.g., collections, charges) of particle material onto a moving tow band 23 in a manner that reduces and/or substantially avoids crushing or otherwise damaging the particle material, as will be discussed in more detail below.

Figure 2:
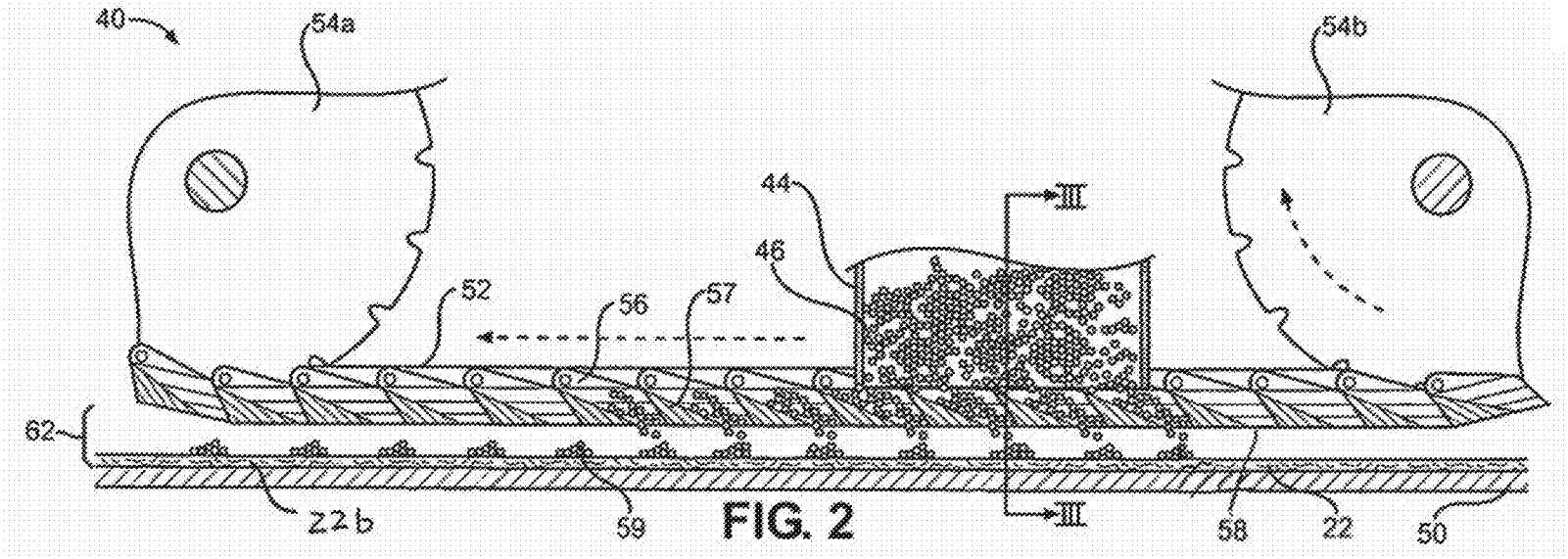
FIG. 2 is a partial side view of a granular inserter utilized in accordance with at least one example embodiment.
Figure 3:
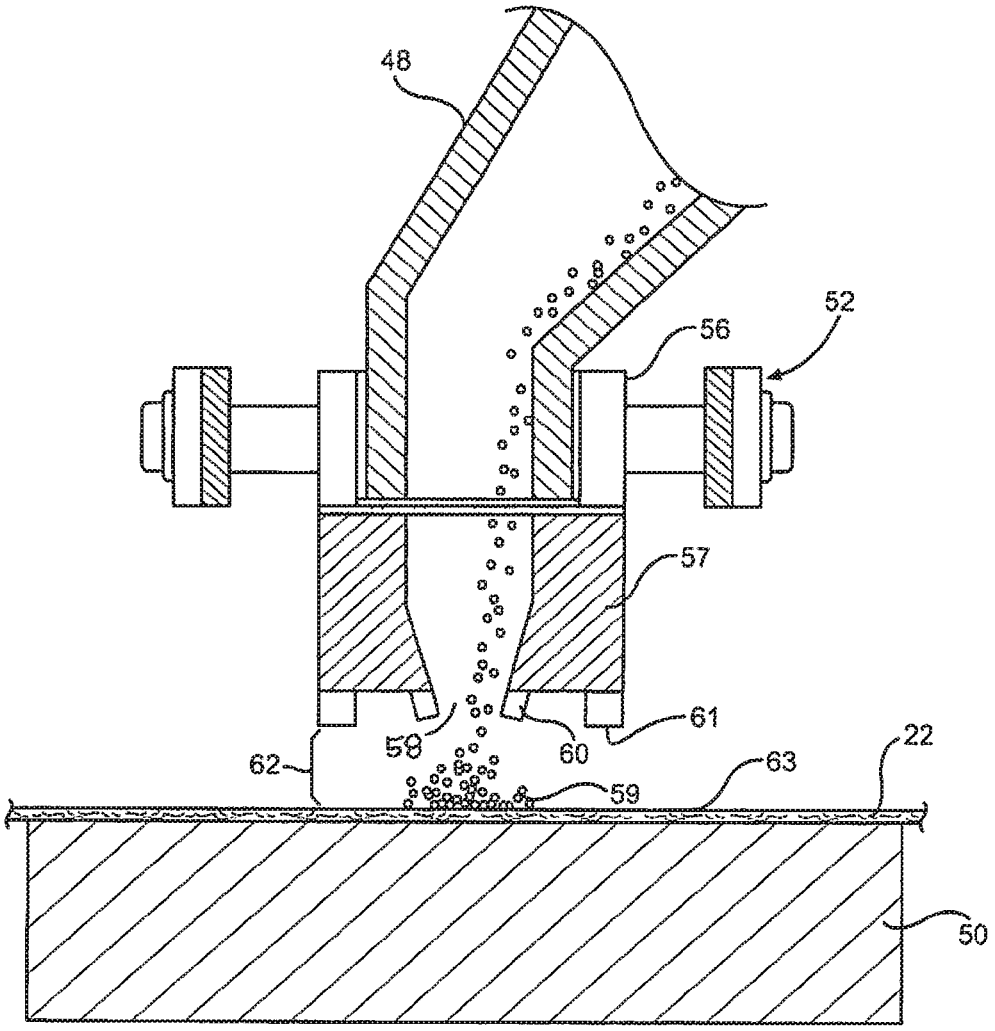
FIG. 3 is a section on line III-III of FIG. 2 according to at least one example embodiment.

In at least one example embodiment, as shown in FIGS. 2 and 3, the particle distribution apparatus 40 of at least one example embodiment comprises a particle reservoir 44 for the retention of a supply of particle material 46. The particle distribution apparatus 40 can be based on known charcoal granule inserters, such as the one shown in U.S. Pat. No. 3,623,404, which is hereby incorporated by reference in its entirety. In some example embodiments, the particle distribution apparatus 40 is structured and arranged to distribute frangible and/or breakable particle material, such as flavor capsules or micro-beads. Flavor capsules can contain one or more desired flavoring agents, such as menthol or mint, and may be structured and arranged to release the flavoring agent(s) when crushed or otherwise broken. In some example embodiments, the flavor capsules or micro-beads are generally relatively small particles, ranging from about 1.0 mm to about 1.5 mm in diameter. This range of sizes has been found to lodge more easily into the filamentary material (tow) and produce a more uniform appearance.

In some example embodiments, a reservoir chute 48 feeds loose particle material 46 by gravity from reservoir 44 along a chute at a steady rate. In some example embodiments, suitable conveyors (not shown) may vibrate to cause the particle material 46 to flow in an orderly fashion to chute 48. Conveyance of particle material 46 may be done without grinding or breaking of the particle material, such that flavor beads are protected from harsh treatment prior to distribution by particle distribution apparatus 40.

In at least one example embodiment, an apertured distribution belt 52 of particle distribution apparatus 40 may move in synch, at the same speed and direction, with the continuous stream of filamentary material 22. The apertured distribution belt 52 may be in the form of an endless chain carried by sprocket wheels 54*a*, 54*b*, but could be in another form conducive to distribution of particle material through defined apertures. Some known distribution belts are shown in U.S. Pat. No. 3,623,404, for example. A support structure 50 may be in the form of a planar stationary support or a planar moving conveyor. In the case where the support structure 50 is a moving conveyor, the speed of the conveyor may be set at a speed equal to the speed of the distribution belt 52 and the continuous stream of filamentary material 22. The support structure 50 may be a solid support structure, or an apertured support structure. In at least one example embodiment, the support structure 50 need not include any specialized troughs or channels through which filamentary material is transported. In some example embodiments, the support structure 50 includes a planar, solid, stationary support structure.

In at least one example embodiment, the distribution belt 52 may comprise a series of links 56, each of which may be transversely apertured to define a funnel 57 having an opening 58 through which particle material 46 may be conveyed onto filamentary material 22 to form discrete piles of particle material 59. Each link 56 may be provided with side cheeks 60 at its lower end to help guide particle material 46 into discrete piles 59.

A bottom portion 61 of the apertured distribution belt 52, such as a bottom of side cheeks 60, may terminate at a distance from support structure 50, establishing a particle accumulation space 62 between a top 63 of the continuous stream of filamentary material 22 and the bottom portion of belt 52. Particle accumulation space 62 may be as small as possible, while accommodating the desired (or, alternatively predetermined) height of particle piles 59 to be distributed on the continuous stream of filamentary material 22, in order to avoid scattering of material 46. Belt 52 may be structured and arranged to deliver a discrete volume of particle material, and in certain example embodiments the belt matches the speed of the advancing filamentary material 22. As the particle material 46 falls from the belt 52 to the filamentary material 22, it imbeds into the tow with very little movement or registration issues.

In some example embodiments, the plasticizer is applied to the filamentary material 22 directly upstream of the particle distribution apparatus 40, such that the filamentary material 22 is still wet with plasticizer when the particle material 46 is dispensed thereon. With this configuration, the particle material 46 is adhered to the filamentary material 22 by the plasticizer, which aids in the reduction and/or prevention of unintentional particle scattering during distribution of particle material 46. Optionally, the support structure 50 may include apertures in communication with a vacuum apparatus (not shown) to draw air downward through the continuous stream of filamentary material 22 and thereby draw particle material 46 against the filamentary material 22 to further aid in the retention of particle material 46 on the filamentary material 22.

In at least one example embodiment, the distribution belt 52 may be advanced at substantially the same speed as the continuous stream of filamentary material 22, and each funnel 57 may be passed beneath the mouth of chute 48 so as to receive particle material 46 at a steady rate as the belt 52 is advanced. Accordingly, the amount of particle material 46 distributed through each funnel 57 may be determined by the speed of travel of belt 52, by the rate of feed of the material 46, by the length of the mouth of chute 48, and by the distance between the particle distribution apparatus 40 and the filamentary material 22. Thus, it is possible to vary the quantity of material distributed to piles 59 by changing one of these parameters. Once material 46 is distributed, the resulting particle-bearing continuous strand **22*b* may be then transported to the filter rod maker 70**.

Figure 4:
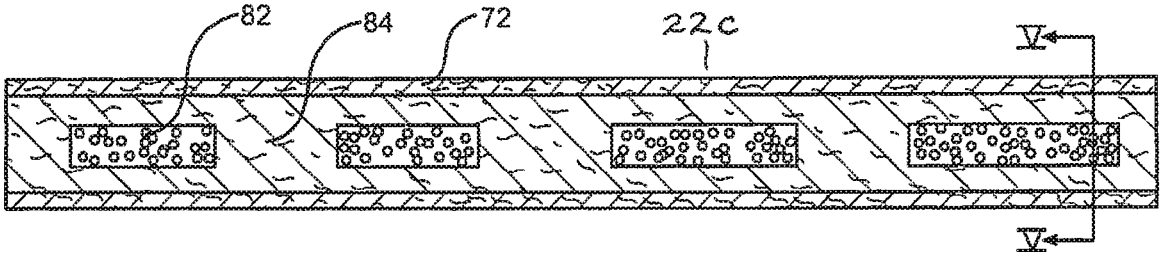
FIG. 4 is a cross-sectional side view of a continuous cigarette filter rod constructed in accordance with at least one example embodiment.

In at least one example embodiment, referring back to FIG. 1, the filter rod maker 70 is located downstream of the particle distribution apparatus 40 for wrapping leading portions of a continuous filter wrap 72 about the particle-bearing continuous stream of filamentary material **22*b*. The rod forming device 70 may be a known device modified for use with the systems and methods disclosed herein, such as a KDF2-E apparatus from Hauni-Korber AG of Hamburg, Germany. In some example embodiments, the rod maker apparatus 70 includes a closing unit or garniture 71, which draws the particle bearing filamentary stream 22*b* together with the filter wrap 72 and seals the latter along a seam line with an adhesive that is administered along the filter wrap 72 by a glue applicator (not shown). In at least one example embodiment, closing shoe 71 may close the particle-bearing stream of filamentary material 22*b* so as to capture the metered particulate material at discrete locations within a continuous rod 22*c* of filamentary material (FIG. 4). It should be understood that various configurations could be utilized to administer the filter wrap 72**, such as the method depicted in U.S. Pat. No. 6,723,033, which is hereby incorporated herein by reference in its entirety.

Figure 5:
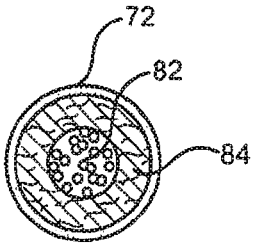
FIG. 5 is a cross-sectional as viewed from line V-V in FIG. 4 according to at least one example embodiment.
Figure 6:
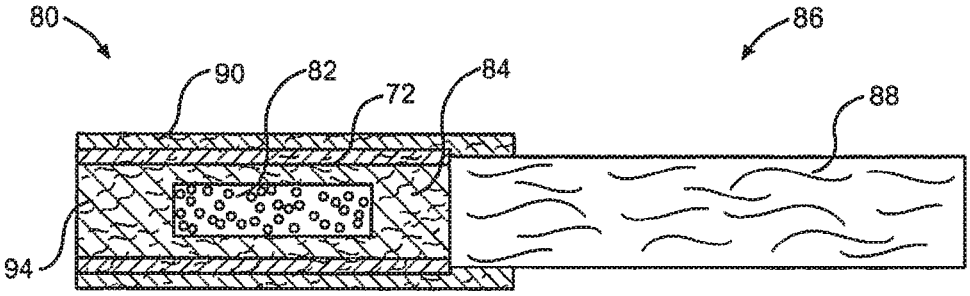
FIG. 6 is a filter cigarette constructed in accordance with at least one example embodiment.

In at least one example embodiment, once a continuous rod **22*c* is formed, continuous rod 22*c* enters cutter 78 to be cut into individual filter plugs 80 of a desired (or, alternatively predetermined) length, such as the configuration shown in FIG. 6, pairs of filter plugs, such as 2-up filter plugs, or other desired multiple or singular forms (if multiple, additional cutting operations may be used). The action of cutter 78 may be registered and synchronized with the action of the particle distribution apparatus 40 so that end portions of the plugs 80 are fibrous and free of any particle material, and particle charges 82 are enclosed within each filter plug 80. As depicted in FIGS. 4 and 5, each filter plug 80 includes fibrous portions 84, which have been folded about a respective charge of particle material 82**.

In at least one example embodiment, as shown in FIG. 6, a cigarette 86 includes a wrapped tobacco rod 88, which is attached by a tipping paper 90 to an individual filter plug 80 having a single charge of metered particle material 82 within it and including folded portions of fibrous material 84 adjacent thereto. Optionally, a mouthpiece filter (not shown) may be provided at a free end portion 94 of filter plug 80.

In some example embodiments, the metered particle material 82 may be positioned from about 5 to about 15 mm from the mouth end of the filter. When laser perforation is required, in certain example embodiments particle material 82 may be positioned about 14 mm from the mouth end of the filter, otherwise 8 mm from the mouth end may be sufficient for other embodiments of cigarette designs. In certain example embodiments, the length of the charge of particle material 82 may vary from about 4 mm to about 16 mm, depending upon the filter design.

The exemplary embodiments described above illustrate but are not limiting. In view of the above discussed exemplary embodiments, other embodiments consistent with the above exemplary embodiments will now be apparent to one of ordinary skill in the art.

What is claimed is:

1. A system for manufacturing a filter comprising:

a filamentary material delivery apparatus configured to distribute filamentary material;

a support structure configured to support a continuous stream of filamentary material supplied by the filamentary material delivery apparatus, the support structure being a solid, planar support structure; and a particle distribution apparatus configured to distribute particles, the particle distribution apparatus disposed downstream of the filamentary material delivery apparatus, the particle distribution apparatus including, a hopper configured to store particle material having an outlet; and an apertured distribution belt positioned above the support structure and in communication with the outlet of the hopper, the apertured distribution belt defining a plurality of spaced openings through which particle material is distributed onto the continuous stream of filamentary material to form a particle-bearing stream of filamentary material.

2. The system of claim 1, wherein the particle-bearing stream of filamentary material further comprises:

discrete spaced-apart groupings of the particle material.

3. The system of claim 2, further comprising:

a closing unit downstream of the particle distribution apparatus, the closing unit configured to close the particle-bearing stream of filamentary material so as to capture groupings of particle material at discrete locations within a closed rod of filamentary material.

4. The system of claim 3, further comprising:

a cutter downstream of the closing unit, the cutter configured to cut the closed rod into discrete filter plugs or 2-up pairs of filter plugs.

5. The system of claim 1, further comprising:

a fluid applicator configured to apply fluid to the continuous stream of filamentary material upstream of the particle distribution apparatus, such that that particle material is distributed onto a wet continuous stream of filamentary material.

6. The system of claim 5, wherein the fluid is a plasticizer, and the particle material distributed onto the wet continuous stream of filamentary material is at least partially adhered to the continuous stream of filamentary material by the plasticizer.

7. The system of claim 1, wherein the continuous stream of filamentary material below the particle distribution apparatus has a planar, ribbon-like shape.

8. The system of claim 1, wherein the particle material comprises:

rupturable beads.

9. The system of claim 1, wherein the particle material comprises:

carbon granules.

10. The system of claim 1, wherein the apertured distribution belt is advanced at a same speed as the continuous stream of filamentary material.

11. The system of claim 1, wherein a bottom of the apertured distribution belt is mounted at a distance from the support structure such that a particle accumulation space is provided between the particle distribution apparatus and the continuous stream of filamentary material.

12. A method for manufacturing a filter comprising:

advancing a continuous stream of filamentary material along a solid, planar support structure located beneath a particle distribution apparatus; and distributing particle material through spaced openings in an aperture distribution belt of the particle distribution apparatus onto the continuous stream of filamentary material, to form a particle-bearing stream of filamentary material.

13. The method of claim 12, wherein the particle-bearing stream of filamentary material contains discrete spaced-apart groupings of the particle material.

14. The method of claim 13, further comprising:

closing the particle-bearing stream of filamentary material so as to capture groupings of particle material at discrete locations within a closed rod of filamentary material.

15. The method of claim 14, further comprising:

cutting the closed rod into discrete filter plugs or 2-up pairs of filter plugs.

16. The method of claim 12, further comprising:

applying fluid to the continuous stream of filamentary material upstream of the particle distribution apparatus, such that that particle material is distributed onto a wet continuous stream of filamentary material.

17. The method of claim 16, further comprising:

applying a plasticizer as the fluid, such that the particle material distributed onto the wet continuous stream of filamentary material is at least partially adhered to the continuous stream of filamentary material by the plasticizer.

18. The method of claim 12, further comprising:

distributing the particle material onto the continuous stream of filamentary material having a planar, ribbon-like shape.

19. The method of claim 12, further comprising:

distributing the particle material having rupturable beads.

20. The method of claim 12, further comprising:

distributing the particle material having carbon granules.

21. The method of claim 12, further comprising:

advancing the aperture distribution belt at a same speed as the continuous stream of filamentary material.

22. The method of claim 12, further comprising:

distributing particle material through the spaced openings in the apertured distribution belt which is mounted at a distance from the support structure such that the particle material crosses a particle accumulation space provided between the particle distribution apparatus and the continuous stream of filamentary material after passing through the spaced openings.

23. The method of claim 12, further comprising:

drawing air through the continuous stream of filamentary material to draw the particle material against the filamentary material.

* * * * *